US010043506B2

(12) United States Patent
Soda

(10) Patent No.: US 10,043,506 B2
(45) Date of Patent: Aug. 7, 2018

(54) ELECTRONIC PERCUSSION INSTRUMENT AND METHOD FOR CONTROLLING SOUND GENERATION

(71) Applicant: CASIO COMPUTER CO., LTD., Shibuya-ku, Tokyo (JP)

(72) Inventor: Takashi Soda, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/715,065

(22) Filed: Sep. 25, 2017

(65) Prior Publication Data

US 2018/0090119 A1 Mar. 29, 2018

(30) Foreign Application Priority Data

Sep. 26, 2016 (JP) ..... 2016-186846

(51) Int. Cl.

| | |
|---|---|
| ***G10H 1/00*** | (2006.01) |
| ***G10H 3/22*** | (2006.01) |
| ***G10H 1/44*** | (2006.01) |
| ***G10H 1/46*** | (2006.01) |

(52) U.S. Cl.

CPC ..... *G10H 3/22* (2013.01); *G10H 1/44* (2013.01); *G10H 1/46* (2013.01); *G10H 2210/051* (2013.01); *G10H 2220/161* (2013.01); *G10H 2220/561* (2013.01)

(58) Field of Classification Search

CPC ..... G10D 13/024; G10H 3/143; G10H 3/146; G10H 3/18; G10H 3/183; G10H 3/186; G10H 2220/525; G10H 2230/305; G10H 3/22; G10H 2220/161; G10H 2220/561; G10H 1/44; G10H 1/46; G10H 2210/051

USPC ..... 84/615, 730

See application file for complete search history.

(56) References Cited

U.S. PATENT DOCUMENTS

| | | | | |
|---|---|---|---|---|
| 3,725,561 A * | 4/1973 | Paul | G10H 3/146 | 381/118 |
| 5,134,920 A * | 8/1992 | Clark | G10H 3/146 | 84/477 R |
| 5,449,964 A * | 9/1995 | Snyder | G10H 1/0556 | 310/327 |
| 5,811,709 A * | 9/1998 | Adinolfi | G10D 13/024 | 84/723 |
| 6,601,436 B1 * | 8/2003 | Senda | G10H 3/146 | 73/12.09 |
| D497,935 S * | 11/2004 | Kamijima | D17/22 | |

(Continued)

FOREIGN PATENT DOCUMENTS

| | | |
|---|---|---|
| JP | 2004280007 A | 10/2004 |
| JP | 2006030476 A | 2/2006 |
| JP | 2010066659 A | 3/2010 |

*Primary Examiner* — Jeffrey Donels

(74) *Attorney, Agent, or Firm* — Holtz, Holtz & Volek PC

(57) ABSTRACT

An electronic percussion instrument to control generated sound in accordance with operation to the striking surface includes: a first sensor configured to detect a slapping operation on the striking surface; a second sensor configured to detect a contact operation to the striking surface; and a processor configured to control sound generated in response to detection of a slapping operation by the first sensor in accordance with a place of a contact operation to the striking surface detected by the second sensor.

15 Claims, 9 Drawing Sheets

(56) References Cited

U.S. PATENT DOCUMENTS

| | | | | |
|---|---|---|---|---|
| 7,038,117 | B2 * | 5/2006 | Yoshino | G10H 3/146 84/411 R |
| 9,263,020 | B2 * | 2/2016 | Takasaki | G10H 3/146 |
| 9,536,509 | B2 * | 1/2017 | Esparza | G10H 3/143 |
| 9,761,212 | B2 * | 9/2017 | Suitor | G10H 3/18 |
| 9,805,703 | B2 * | 10/2017 | Esparza | G10H 3/146 |
| 2003/0161493 | A1 * | 8/2003 | Hosler | G10H 3/146 381/353 |
| 2004/0134332 | A1 * | 7/2004 | Kamijima | G10H 3/146 84/411 R |
| 2005/0150366 | A1 * | 7/2005 | Susami | G10H 3/146 84/735 |
| 2005/0262991 | A1 * | 12/2005 | Arimoto | G10H 1/06 84/735 |
| 2011/0116634 | A1 * | 5/2011 | Norman | H04L 9/3247 380/277 |
| 2013/0333545 | A1 * | 12/2013 | Dunwoodie | G10H 3/181 84/726 |
| 2014/0208926 | A1 * | 7/2014 | Shepherd | G10D 13/021 84/730 |
| 2015/0262567 | A1 * | 9/2015 | Truchsess | G10H 1/32 84/725 |

* cited by examiner

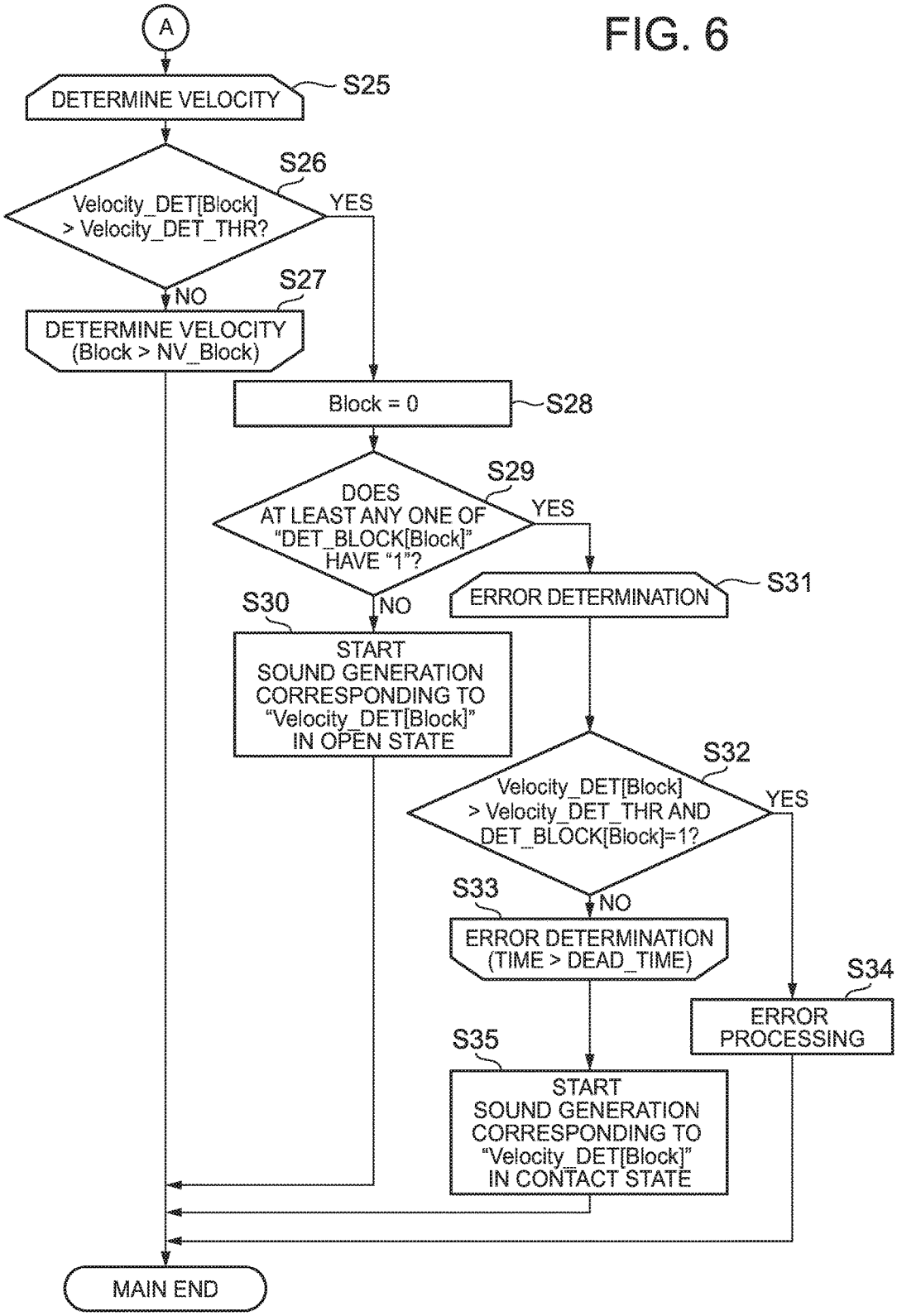
FIG. 6
A
DETERMINE VELOCITY
S25
S26
Velocity_DET[Block] > Velocity_DET_THR?
YES
NO
S27
DETERMINE VELOCITY (Block > NV_Block)
Block = 0
S28
S29
DOES AT LEAST ANY ONE OF "DET_BLOCK[Block]" HAVE "1"?
YES
NO
ERROR DETERMINATION
S31
S30
START SOUND GENERATION CORRESPONDING TO "Velocity_DET[Block]" IN OPEN STATE
S32
Velocity_DET[Block] > Velocity_DET_THR AND DET_BLOCK[Block]=1?
YES
NO
S33
ERROR DETERMINATION (TIME > DEAD_TIME)
S34
ERROR PROCESSING
S35
START SOUND GENERATION CORRESPONDING TO "Velocity_DET[Block]" IN CONTACT STATE
MAIN END

ELECTRONIC PERCUSSION INSTRUMENT AND METHOD FOR CONTROLLING SOUND GENERATION

BACKGROUND OF THE INVENTION

1. Field of the Invention

The present invention relates to electronic percussion instruments, such as an electronic cajon.

2. Description of the Related Art

Conventionally known percussion instruments include an acoustic percussion instrument not having a function of amplifying the sound electrically and an electronic percussion instrument configured to detect a striking operation and electrically amplify the sound generated in accordance with the strength detected and the struck position for outputting. For instance, Patent Document 1 describes an electronic percussion instrument including four sensor units including a piezoelectric device on the rear face of the striking surface. This percussion instrument is configured to detect a sound by the sensor units about the strength or the position of striking and amplifies the sound electrically in accordance with the strength and the position for outputting.

[Patent Document 1] Japanese Patent Application Laid-Open No. 2006-030476

SUMMARY OF THE INVENTION

One aspect of the present invention relates to an electronic percussion instrument having a surface. The electronic percussion instrument includes: a first sensor configured to detect a striking operation on the surface; a second sensor configured to detect a contact operation to the surface; and a processor configured to control sound generated in response to detection of a striking operation by the first sensor in accordance with a place of a contact operation to the surface detected by the second sensor.

Another aspect of the present invention relates to a method for controlling generated sound executed by a processor. The method includes: detecting a place of a contact operation to a surface, and controlling generated sound in response to detection of a striking operation on the surface in accordance with the detected place of the contact operation.

Another aspect of the present invention relates to a non-transitory recording medium to record a program. The program makes a computer execute the processing of: detecting a place of a contact operation to a surface, and controlling generated sound in response to detection of a striking operation on the surface in accordance with the detected place of the contact operation.

BRIEF DESCRIPTION OF THE SEVERAL VIEWS OF THE DRAWING

FIG. 6 is a flowchart showing the control flow (latter half of the main routine) of the electronic percussion instrument.

DETAILED DESCRIPTION OF THE INVENTION

Figure 1:
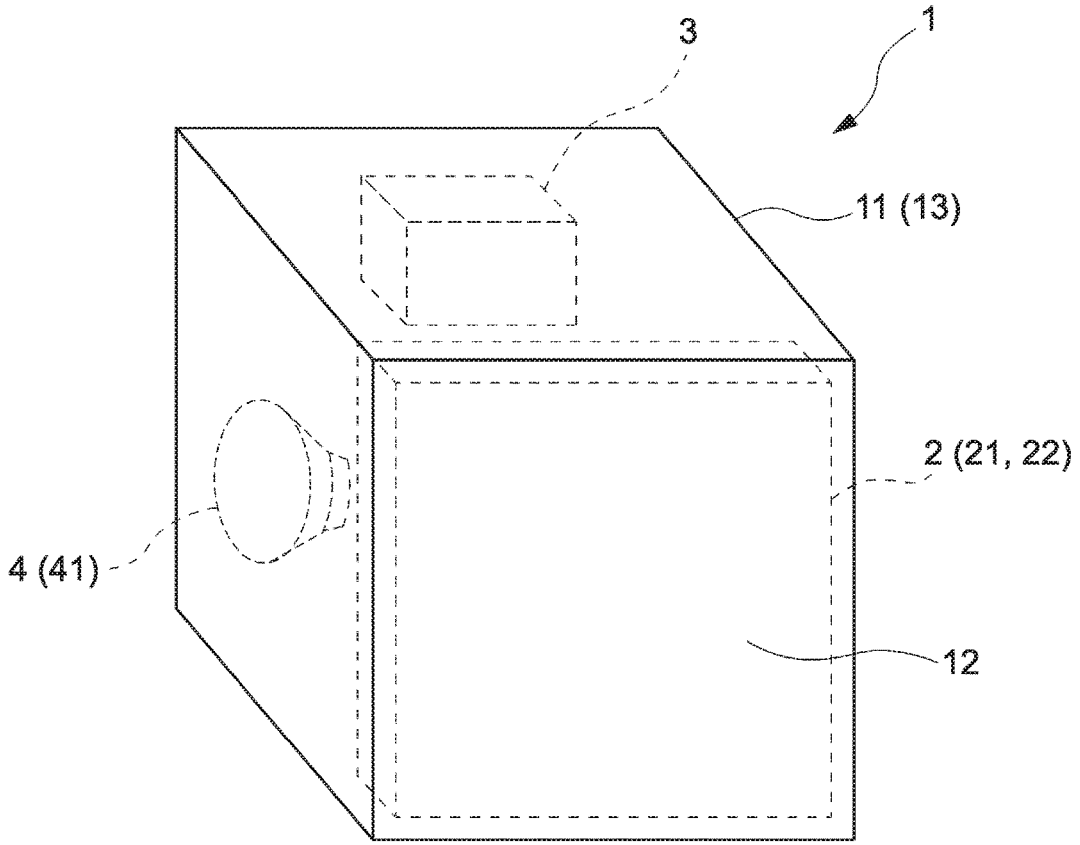
FIG. 1 is a perspective view of an electronic percussion instrument according to one embodiment of the present invention.

The following describes an embodiment of the present invention in details, with reference to the drawings. In the drawings, like reference numerals indicate like parts throughout the description of the embodiment.

<Configuration of Electronic Percussion Instrument>

Figure 2:
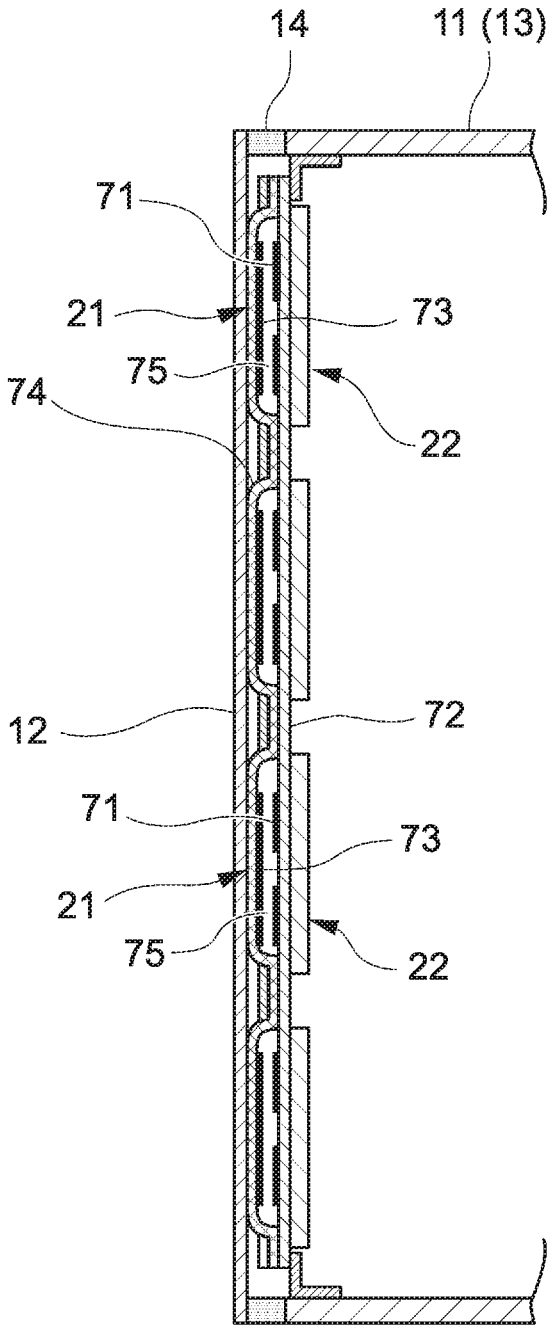
FIG. 2 is a cross-sectional view of the configuration of a striking surface and a detection unit.
Figure 3:
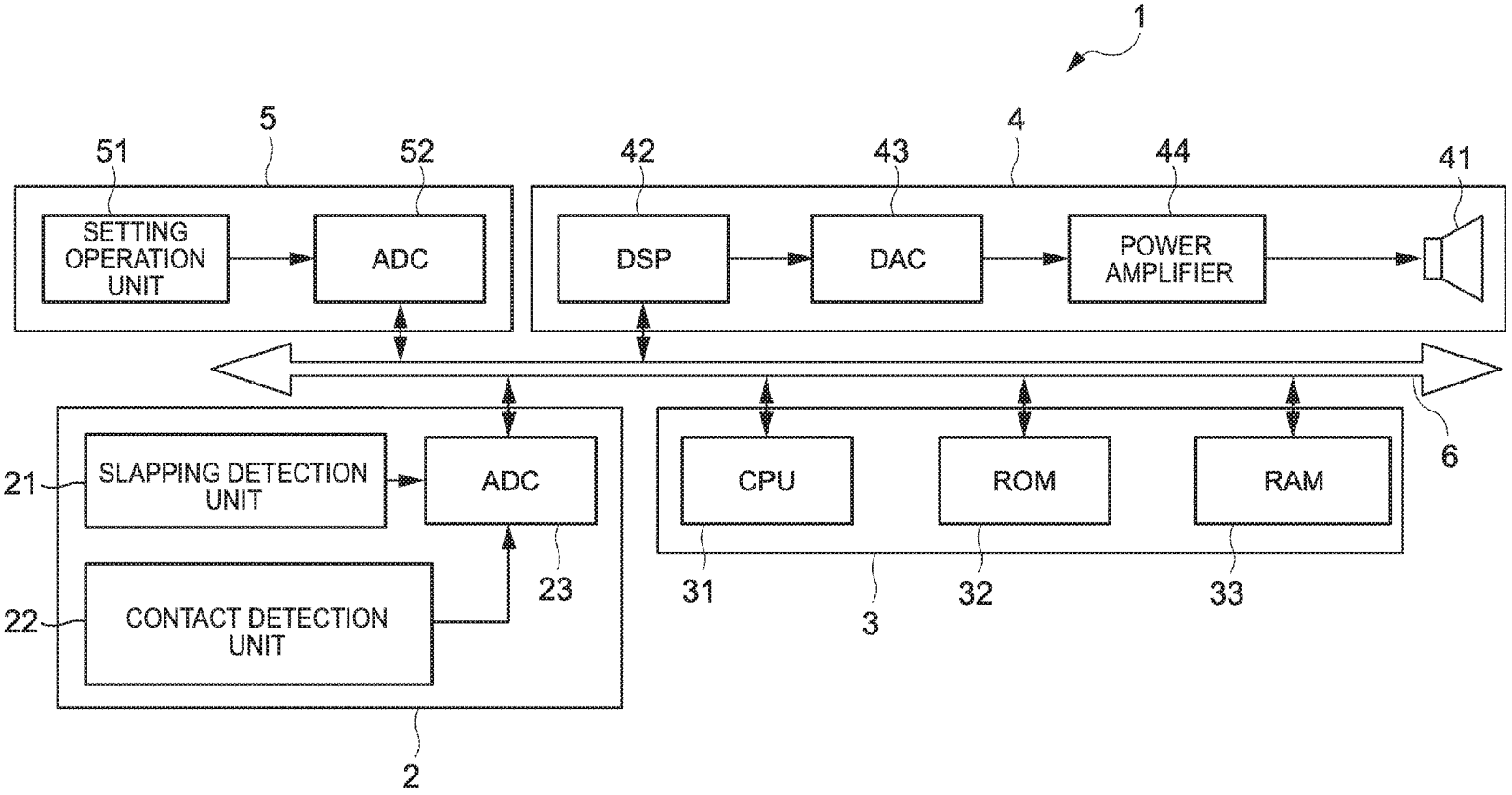
FIG. 3 is a block diagram showing a control block of the electronic percussion instrument.
Figure 4A:
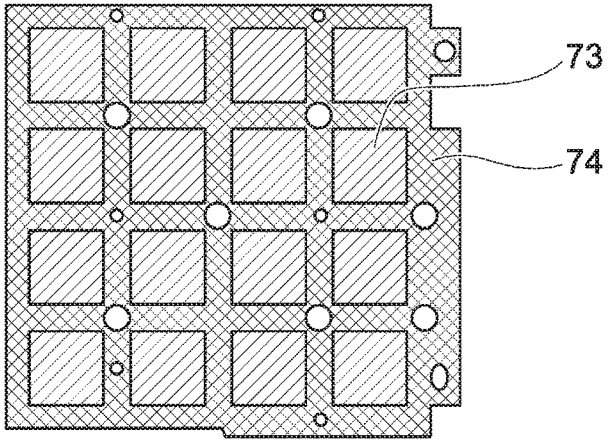
FIGS. 4A-4C are exploded views showing the configuration of a strike detection unit.
Figure 4B:
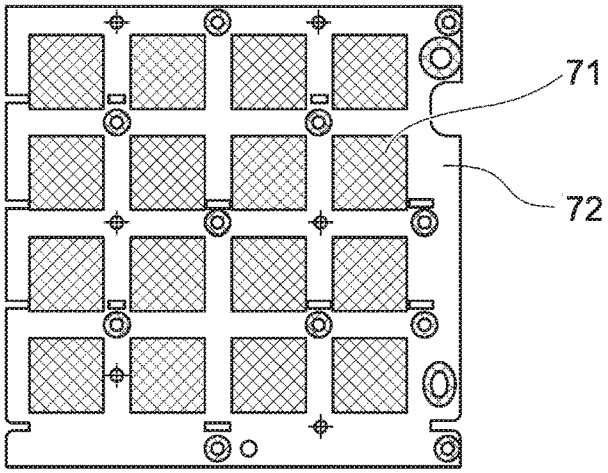
Figure 4C:
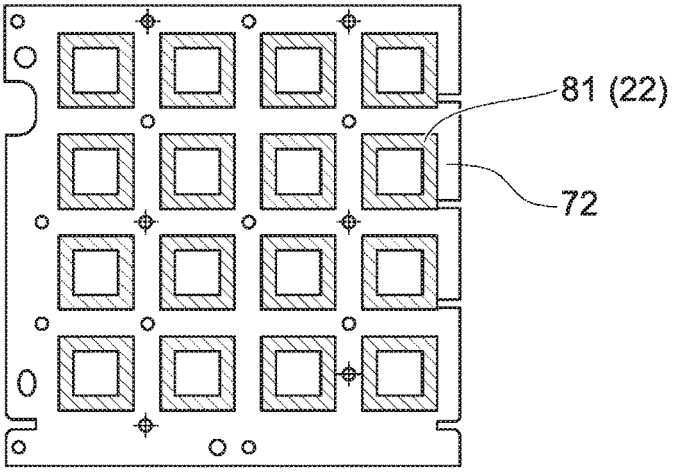

Referring to FIGS. 1 to 4, the following describes the configuration of an electronic percussion instrument according to one embodiment of the present invention. FIG. 1 is a perspective view of an electronic percussion instrument according to one embodiment of the present invention. FIG. 2 is a cross-sectional view of the configuration of a striking surface (a surface for a striking operation and a contact operation) and a detection unit. FIG. 3 is a block diagram showing a control block of the electronic percussion instrument. FIGS. 4A-4C are exploded views showing the configuration of a slapping detection unit. FIG. 4A shows a conductive sheet, FIG. 4B shows the surface of a board, and FIG. 4C shows the rear face of the board.

As shown in FIG. 1, the electronic percussion instrument 1 according to one embodiment of the present invention is an electric cajon, and includes a cubic case 11 having hollow. The front face of the case 11 is a striking surface 12. When a player sits astride the case 11 and slaps the striking surface 12 with one hand or both hands, sound is generated in accordance with the strength and the place of the slapping (striking).

The striking surface 12 is attached to the front face of a case body 13 via an elastic member 14, and the case body makes up the top face, the bottom face, the left and right lateral faces and the back face of the case 11. This allows the striking surface to be displaced entirely in response to a slapping operation as well as to be elastic-deformed partially in response to a slapping operation because the striking surface includes a plate member that can be elastically deformed (see FIG. 2). Such displacement or deformation of the striking surface 12 enables reliable transmission of the force of the slapping operation to a slapping detection unit 21 described later. This enables precise detection of the strength and the place of slapping on the striking surface 12.

As shown in FIG. 3, this electronic percussion instrument 1 includes a detection unit 2, a sound control unit 3, a sound output unit 4, and an input unit 5, and these units are connected mutually via a bus 6.

The following describes these units.

(Detection Unit)

The detection unit 2 includes a plurality of slapping detection units 21 to detect a slapping operation (the strength and the place of slapping) at the striking surface 12, a plurality of contact detection units 22 to detect a contact operation to the striking surface 12, and an A/D conversion unit 23 to convert a detection signal of the slapping detection units 21 and of the contact detection units 22 to a digital signal and output the signal to the bus 6.

The slapping detection units 21 can be in any mode as long as it can detect slapping of the striking surface 12, and may be configured to output a voltage value corresponding to the strength of slapping on the striking surface 12. This may include a vibration sensor that generates voltage in accordance with the strength of vibration or a suppress-strength detection sensor to detect a suppress strength. The present embodiment describes the slapping detection units 21 that are configured to detect the strength of slapping on the striking surface 12 based on a change in resistance that changes with the contacting state between conductive thin films.

The slapping detection units 21 are disposed in a matrix form on one of the faces (hereinafter called a "surface") of a circuit board 72. In the present embodiment, the striking surface 12 is divided into sixteen blocks in total including four in length and four in width. Then sixteen slapping detection units 21 are disposed in a matrix form on the surface of the circuit board 72 so as to detect the slapping operation in their corresponding blocks. The number and the arrangement of the slapping detection units 21 can be changed freely, and the positions of the slapping detection units 21 on the striking surface 12 are stored in the sound control unit 3 or the like. For precise detection of the slapping place on the striking surface 12, the slapping detection units 21 is preferably disposed at at least two places of the striking surface 12, including the center and the upper part.

Specifically as shown in FIG. 2, the slapping detection units 21 include a conductive sheet 74 that is stacked on the surface of the circuit board 72. The circuit board 72 has carbon printing 71 as a conductive thin film on the surface, and the conductive sheet 74 has carbon printing 73 as a conductive thin film thereon. The circuit board 72 and the conductive sheet 74 are stacked so that their carbon printing 71 and carbon printing 73 are opposed via space 75. In the present embodiment, the conductive thin films formed on the base materials are made of carbon, which may be other conductive materials, such as silver and copper.

The carbon printing 71 is disposed at a position corresponding to each of the slapping detection units 21 on the surface of the circuit board 72 (see FIG. 4B), and includes two spirals to form a pair of electrodes, for example. The carbon printing 73 includes solid-printed carbon on the conductive sheet 74 in a range corresponding to the two spirals as the pair of electrodes formed by the carbon printing 71, for example (see FIG. 4A).

When a player slaps the striking surface 12, the space 75 as a gap between the carbon printing 71 and the carbon printing 73 is crashed, so that the pair of electrodes formed with the carbon printing 71 on the circuit board 72 is coupled to the carbon printing 73 on the conductive sheet 74 and so the pair of electrodes of the carbon printing 71 has electrical continuity.

At this time, the contacting area of the carbon printing 73 with the carbon printing 71 changes with the strength of slapping so that the contacting area increases (the resistance decreases) with an increase in the strength of slapping, and so the voltage value at the slapping detection unit 21 increases. The slapping detection unit 21 thus outputs the voltage value corresponding to the strength of slapping. This voltage value is A/D converted by the A/D conversion unit 23, and is output to the bus 6 as a digital signal corresponding to the strength of slapping. The sound control unit 3 detects the digital signal as velocity (slapping strength value). That is, loudness of the sound generated by the sound output unit 4 can be changed with the magnitude of this voltage value.

The slapping detection units 21 can be configured so that the pitch of sound changes with the slapping place (the place where the slapping detection unit is disposed on the striking surface 12). For instance, lower-pitched sound is issued when the player slaps a place close to the center of the striking surface 12, while higher-pitched sound is issued when the player slaps a place closer to the upper part of the striking surface 12. The slapping detection unit 21 may change at least one of loudness of the sound and pitch of the sound with the strength and the place of slapping, or may change both of them.

As shown in FIG. 2, the contact detection units 22 are formed in a matrix form on the other face of the circuit board 72 (hereinafter called a "rear face"). In the present embodiment, the striking surface 12 is divided into sixteen blocks in total including four in length and four in width. Sixteen contact detection units 22 are disposed in a matrix form on the rear face of the circuit board 72 so as to detect the contact operation in their corresponding blocks. The number and the arrangement of the contact detection units 22 can be changed freely, and the positions of the contact detection units 22 on the striking surface 12 are stored in the sound control unit 3 or the like. For precise detection of the contacting position with the right hand or the left hand on the striking surface 12, the contact detection unit 22 is preferably disposed at at least one place at an upper part of the striking surface 12.

The present embodiment describes the contact detection units 22 of a capacitance type. The contact detection units 22 may be of other types, such as a pressure-sensitive type, as long as they can detect a contact.

Specifically the plurality of contact detection units 22 and electric circuits such as antennas 81 (electrodes) are disposed (see FIG. 4C) to detect a contact operation to the striking surface 12 based on a change in capacitance at the striking surface 12. They are configured to detect the capacitance of a virtual capacitor formed between the hand in contact with the striking surface 12 and the antenna 81 and output the capacitance as a voltage value.

When a hand of the player comes into contact with the striking surface 12, the capacitance of the virtual capacitor changes, and so the contact detection units 22 output a voltage value corresponding to contact or non-contact of the hand. This voltage value is A/D converted by the A/D conversion unit 23, and is then output to the bus 6 as a digital signal corresponding to the capacitance. The sound control unit 3 detects it as a capacitance value.

The contact detection units 22 are configured so that sound generated changes between a contact and non-contact of the player's hand with the striking surface 12. For instance, the sound can be cancelled and be echoed when the hand comes into contact there and does not come into contact there, respectively. The sound may be changed in accordance with a contact position, such as at an upper part.

The present embodiment includes the slapping detection units 21 and the contact detection units 22 in the same number so that their detection areas substantially coincide. The numbers of the slapping detection units 21 and the contact detection units 22 may be different, and their detection areas may be displaced.

(Sound Control Unit)

The sound control unit 3 includes a CPU 31, a ROM 32 and a RAM 33, which are mutually connected via the bus 6. The sound control unit is connected to the detection unit 2, the sound output unit 4 and the input unit 5, and functions as a musical-sound generation instruction device. The CPU 31 functions as a processor of the musical-sound generation instruction device, and controls the electronic percussion instrument 1 as a whole and executes various types of processing. This includes processing to generate sound in accordance with a slapping operation and a contact operation on the striking surface 12, processing to let the sound output unit 4 issue sounds, and processing to change the play mode, the tone and the volume of the sound in accordance with setting at the input unit 5.

The ROM 32 stores a program describing the various types of processing executed by the CPU 31 as well as waveform data to generate various types of musical sound corresponding to the plurality of slapping detection units 21 and the plurality of contact detection units 22. The RAM 33 stores a program read from the ROM 32 and data created during the processing by the CPU 31.

The sound control unit 3 determines whether the hand coming into contact with the striking surface 12 is to perform a slapping operation or a contact operation. To this end, the sound control unit determines that the player performs a contact operation to the striking surface 12 when the contact detection unit 22 detects and outputs a capacitance value (output value) more than a threshold for a set period of time. This set period of time may be a fixed value specific to the electronic percussion instrument 1 or may be a variable that can be changed with a song performed or the rhythm.

(Sound Output Unit)

The sound output unit 4 includes a speaker 41 to output sound, a digital signal processor 42, a D/A conversion unit 43, and a power amplifier 44. The speaker 41 is connected to the digital signal processor 42 via the power amplifier 44 and the D/A conversion unit 43, and the digital signal processor 42 is connected to the sound control unit 3 via the bus 6. The sound output unit 4 D/A converts generated sound data created by the sound control unit 3 into an analog waveform signal, and outputs the signal to the speaker 41 via the power amplifier 44.

(Input Unit)

The input unit 5 includes a setting operation unit 51 to allow a user to perform various types of setting operation, and an A/D conversion unit 52 to convert a setting signal at the setting operation unit 51 into a digital signal and output the signal to the bus 6. The setting operation unit 51 enables a selection of the play mode, a selection of the tone, a selection of the volume of sound and the like. The sound control unit 3 detects a setting signal at the input unit 5 via the bus 6 to change the play mode, the tone, the volume of sound and the like.

<Control Procedure of Electronic Percussion Instrument>

Figure 5:
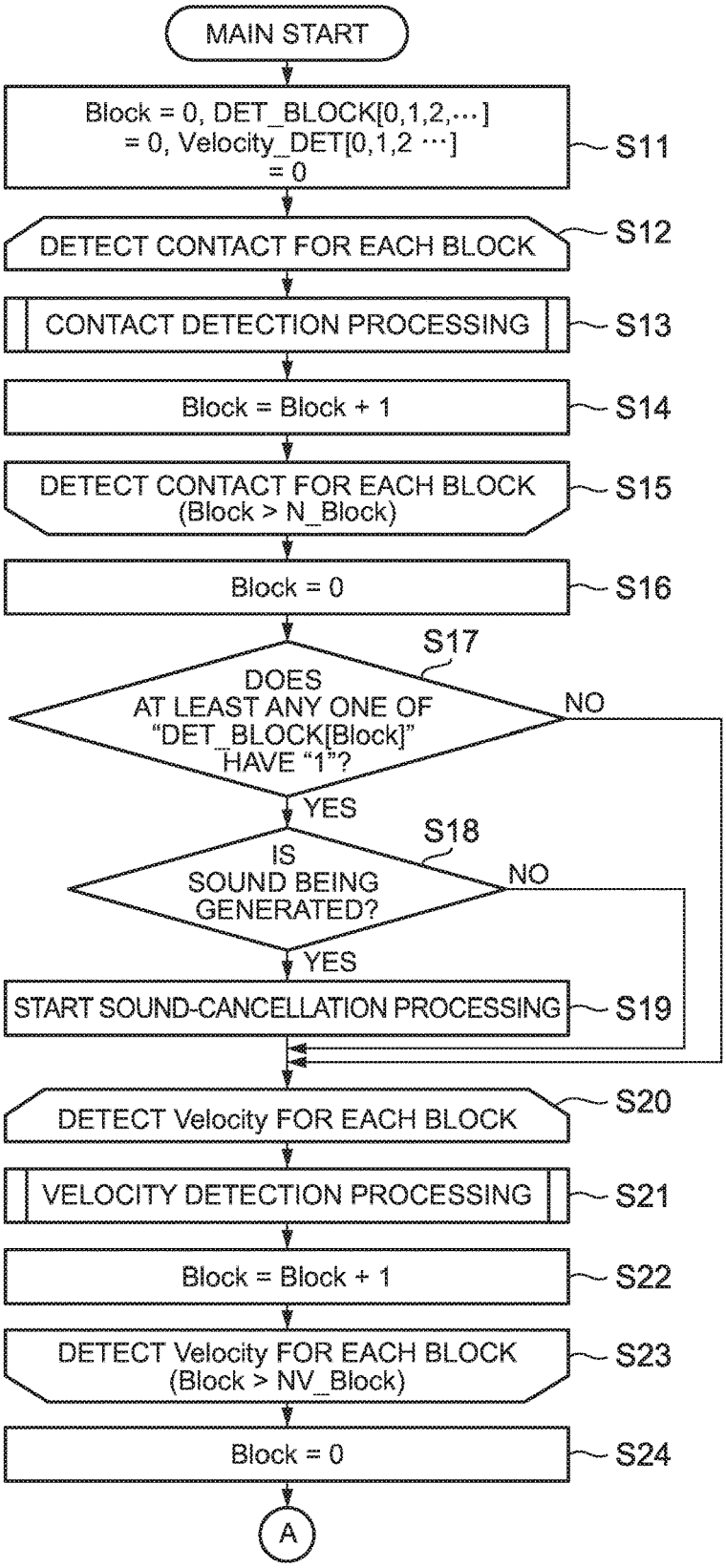
FIG. 5 is a flowchart showing the control flow (first half of the main routine) of the electronic percussion instrument.
Figure 7:
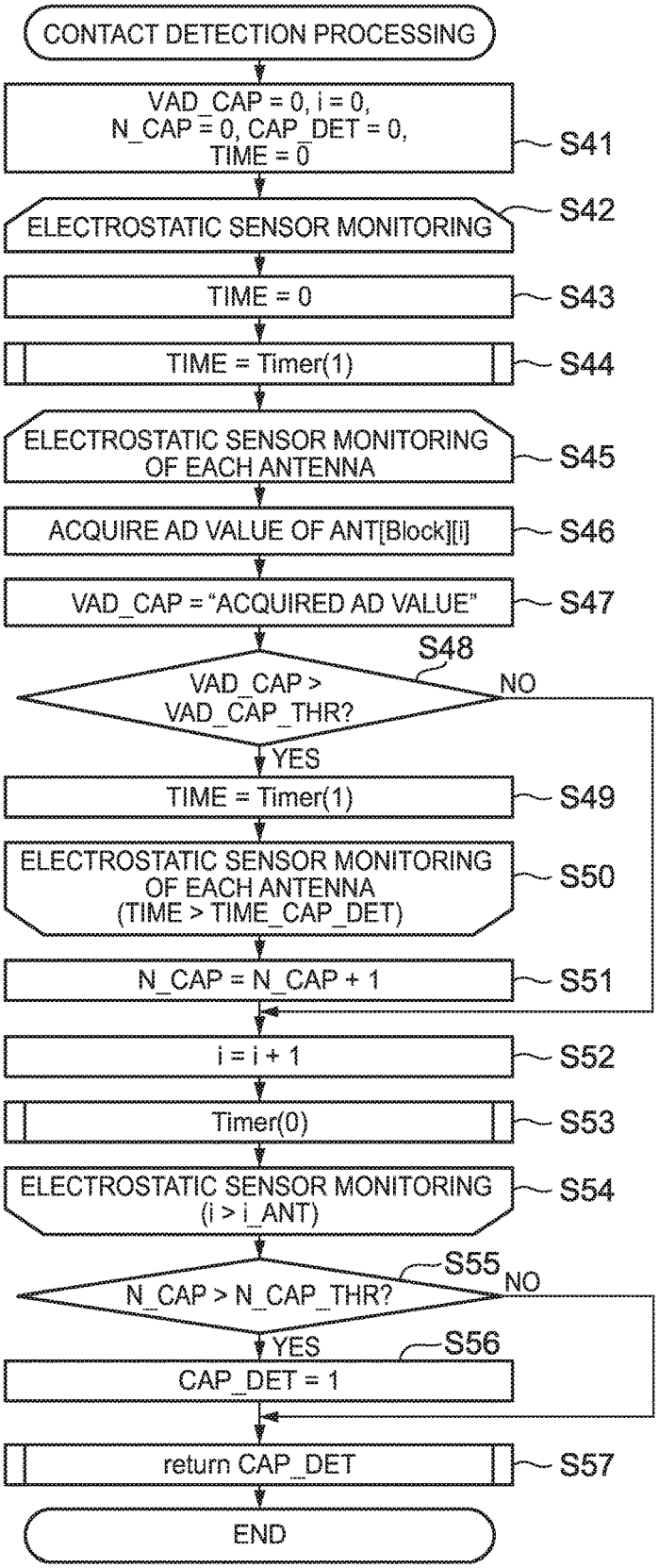
FIG. 7 is a flowchart showing the control flow (contact detection processing) of the electronic percussion instrument.
Figure 8:
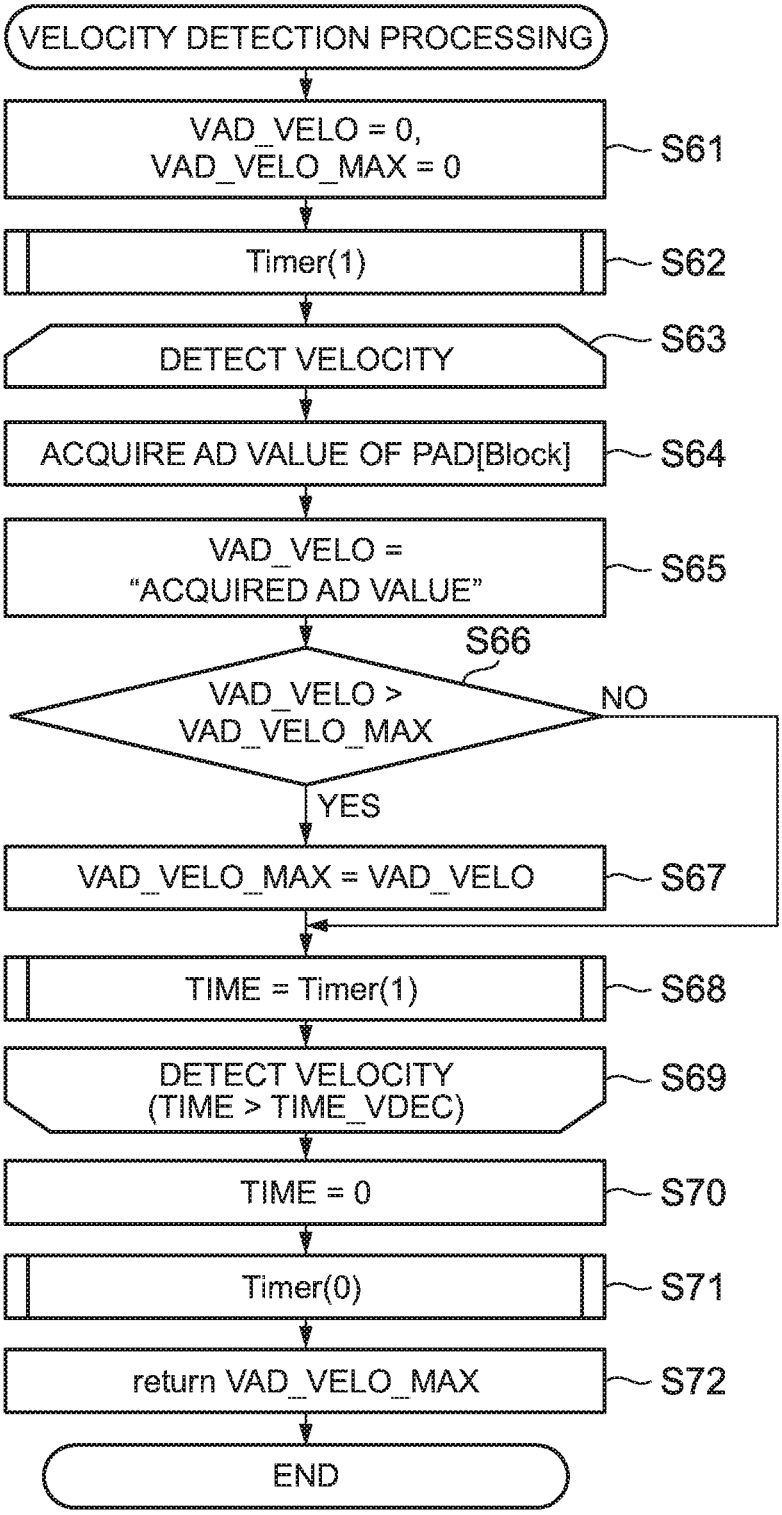
FIG. 8 is a flowchart showing the control flow (velocity detection processing) of the electronic percussion instrument.
Figure 9:
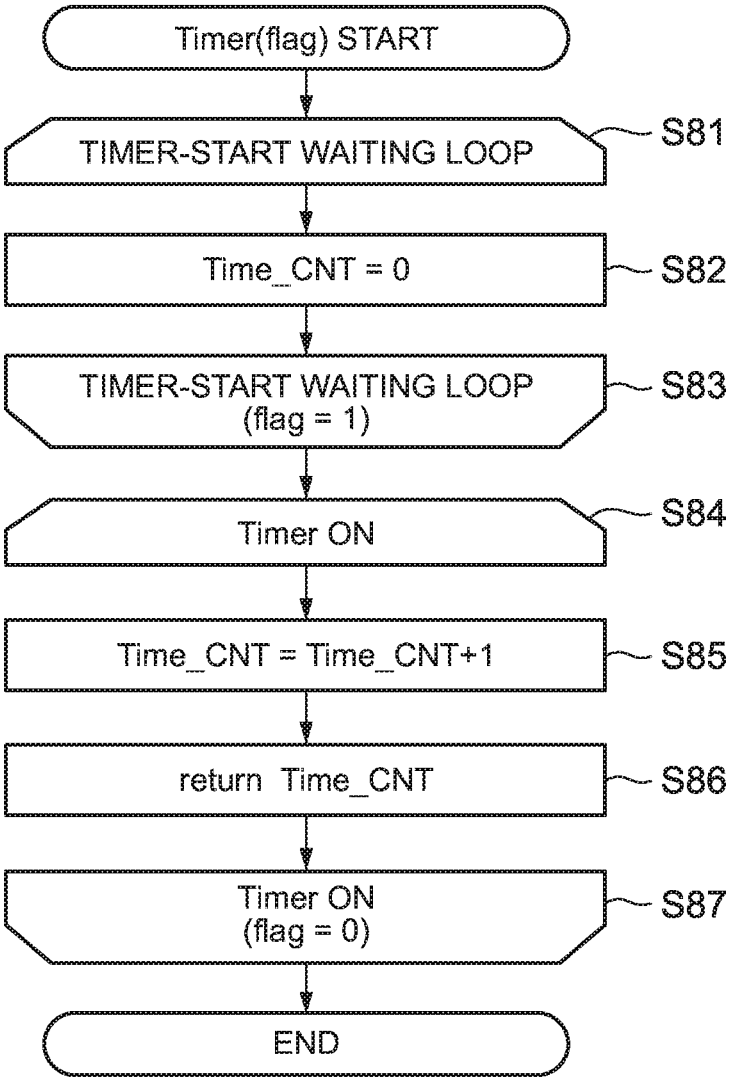
FIG. 9 is a flowchart showing the control flow (timer processing) of the electronic percussion instrument.

Referring now to FIGS. 5 to 9, the following describes control flow of the electronic percussion instrument 1 (sound control unit 3) in the present embodiment in details. FIG. 5 is a flowchart showing the control flow (the first half of the main routine) of the electronic percussion instrument. FIG. 6 is a flowchart showing the control flow (the latter half of the main routine) of the electronic percussion instrument. FIG. 7 is a flowchart showing the control flow (contact detection processing) of the electronic percussion instrument. FIG. 8 is a flowchart showing the control flow (velocity detection processing) of the electronic percussion instrument. FIG. 9 is a flowchart showing the control flow (timer processing) of the electronic percussion instrument.

(Main Routine)

As shown in FIGS. 5 and 6, when executing the main routine, the sound control unit 3 firstly initializes variables to be used(=0) (Step S11). The variables to be initialized here include a variable "Block" to designate a block of the slapping detection units 21 and the contact detection units 22, an array variable "DET_BLOCK[0,1,2, . . . . ]" to determine whether the contact detection unit 22 at each block is in a contact detected state or not (non-contacted=0. contacted=1), and an array variable "Velocity_DET[0,1,2, . . . . ]" to determine the velocity of the slapping detection unit 21 at each block.

Next, in the loop processing from Step S12 to Step S15, the sound control unit 3 determines whether a contact operation is performed or not for all of the blocks of the contact detection units 22. This determination processing is performed by repeatedly executing a contact detection processing (see FIG. 7) as an external function while incrementing the value of the variable "Block" until the value of the variable "Block" exceeds the block upper limit "N_Block" of the contact detection units 22 (in this embodiment, "15"). In this determination, when the value of the array variable "DET_BLOCK[Block]" corresponding to the block of the contact detection unit 22 in which a contact operation has been detected becomes "1" or when the loop processing ends, the variable "Block" is initialized (Step S16).

Then, from Step S17 to Step S19, the sound control unit 3 performs sound-cancellation processing in response to the contact operation to the striking surface 12. Firstly, the sound control unit 3 determines whether the number of the array variables "DET_BLOCK[Block]" having the value of "1" is more than 1 or not (Step S17). If this determination results in Yes, the sound control unit 3 determines whether sound is being generated in response to a slapping operation or not (Step S18). If this determination also results in Yes, the sound control unit 3 determines that the operation is to cancel the sound through a contact to the striking surface 12, and then starts a sound-cancellation processing to cancel the current sound (Step S19). That is, when the sound output unit 4 generates sound and the contact detection unit 22 detects a contact, the sound control unit 3 controls to cancel the sound being generated by the sound output unit 4.

In the loop processing from Step S20 to Step S23, the sound control unit 3 performs velocity detection processing for all of the blocks of the slapping detection units 21. This detection processing is performed by repeatedly executing a velocity detection processing (see FIG. 8) as an external function while incrementing the value of the variable "Block" until the value of the variable "Block" exceeds the block upper limit "NV_Block" of the slapping detection units 21 (in this embodiment, "15"). In this detection processing, when the value of the array variable "Velocity_DET[Block]" corresponding to each block of the slapping detection units 21 is the detected velocity value or when the loop processing ends, the variable "Block" is initialized (Step S24).

Next, in the loop processing from Step S25 to Step S27, the sound control unit 3 determines whether a slapping operation occurs or not. This determination is based on whether the velocity at each block of the slapping detection units 21 exceeds a predetermined threshold "Velocity_DET_THR" or not. Herein when the sound control unit 3 determines that the velocities at all of the blocks of the slapping detection units 21 do not exceed the threshold "Velocity_DET_THR", one processing of the main routine ends.

On the contrary, if the sound control unit 3 determines that the velocity at any block exceeds the predetermined threshold "Velocity_DET_THR", the sound control unit 3 initializes the variable "Block" (Step S28). Then the sound control unit determines whether the number of the array variables having the value of "1" is more than 1 or not (Step S29). When this determination results in No, the sound control unit 3 starts the processing to generate sound corresponding to a slapping operation that is performed without a contact operation, i.e., starts to generate sound in accordance with the strength and the place of the slapping specified by the array variable "Velocity_DET[Block]" (Step S30).

When the determination at Step S29 results in Yes, the sound control unit 3 determines whether an error of the contact detection has occurred or not in the loop processing from Step S31 to Step S33. That is, when a slapping operation and a contact operation are detected at the same time at the same block, the slapping operation is likely determined as a contact operation erroneously. Then the sound control unit 3 determines that an error has occurred (YES at Step S32), and cancels the contact detected at the error processing (Step S34). That is, if the slapped place on the striking surface 12 detected by the slapping detection units 21 and the contacted place on the striking surface 12 detected by the contact detection units 22 are within the same range, the sound control unit 3 controls so as not to change the sound generated by the sound output unit 4 based on the contact to the striking surface 12 or the contacted place on the striking surface 12 detected by the contact detection units 22. In other words, the sound control unit 3 controls to generate sound only in accordance with the strength and the place of slapping detected by the slapping detection units 21.

Then when the error determination results in NO, the sound control unit 3 starts to processing to generate sound when a slapping operation is performed while keeping a contact operation. That is, the sound control unit 3 starts to generate sound while considering the strength and the place of the slapping specified by the array variable "Velocity_DET[Block]" as well as the place of contact specified by the array variable "DET_BLOCK[Block]" (Step S35). That is, when the place of slapping on the striking surface 12 detected by the slapping detection units 21 and the place of a contact on the striking surface 12 detected by the contact detection units 22 are different, the sound control unit 3 controls to change the sound generated by the sound output unit 4 based on the contact to the striking surface 12 and the contacted place on the striking surface 12 detected by the contact detection units 22.

(Contact Detection Processing)

As shown in FIG. 7, when executing the contact detection processing, the sound control unit 3 firstly initializes variables to be used(=0) (Step S41). The variables to be initialized here include a variable "VAD_CAP" to store a capacitance value (AD value) of the contact detection units 22, a variable "i" to designate the contact detection units 22, a variable "N_CAP" to determine the number of the contact detection units 22 in the contact detected state, a variable "CAP_DET" to determine whether the contact detection unit 22 at a target block is in the contact detected state or not (non-contacted=0. contacted=1), and a variable "TIME" to store a timer value.

Next, in the loop processing from Step S42 to Step S54, the sound control unit 3 determines whether the contact detection unit 22 as a target block is in the contact detected state or not. This loop processing is repeatedly executed while incrementing the value of the variable "i" until the value of the variable "i" exceeds the upper limit "i_ANT" of the contact detection units 22.

In this loop processing from Step S42 to Step S54, a variable "TIME" is firstly initialized(=0) (Step S43), and then the timer processing as an external function starts (Step S44). Next, in the loop processing from Step S45 to Step S50, the sound control unit 3 determines whether the contact detection unit 22 designated by the variable "i" is in the contact detected state or not. The loop processing from Step S45 to Step S50 is repeated until the timer value of the variable "TIME" exceeds a constant "TIME_CAP_DET". In the loop, the sound control unit 3 firstly acquires a capacitance value of the contact detection unit 22 designated by the variable "BLOCK" and the variable "i" (Step S46), and stores the acquired capacitance value in the variable "VAD_CAP" (Step S47).

Next, the sound control unit 3 determines whether the value of the variable "VAD_CAP" exceeds a predetermined threshold "VAD_CAP_THR" or not (Step S48). When this determination results in YES, the sound control unit 3 updates the variable "TIME" (Step S49) and waits for the elapse of a contact determination time specified by a constant "TIME_CAP_DET". That is, when the state of the value of the variable "VAD_CAP" exceeding the predetermined threshold "VAD_CAP_THR" continues for the contact determination time specified by the constant "TIME_CAP_DET" or longer, the sound control unit 3 determines that the contact detection unit 22 as the target is in the contact detected state.

Then when the sound control unit 3 determines that the contact detection unit 22 as the target is in the contact detected state, the procedure leaves the loop from Step S45 to Step S50. Then, the variable "N_CAP" indicating the number of the contact detection units 22 in the contact detected state is incremented (Step S51). Thereafter, the sound control unit 3 increments the variable "i" (Step S52), and ends the timer processing. Then the procedure returns to Step S42 to shift to determine the contact detection at the next contact detection unit 22.

On the contrary, when the determination at Step S48 results in NO, the procedure leaves the loop from Step S45 to Step S50 without waiting for the elapse of the determination time. Then, Step S51 is skipped, and the sound control unit 3 increments the variable "i" (Step S52), and ends the timer processing. Then the procedure returns to Step S42 to shift to determine the contact detection at the next contact detection unit 22.

When the sound control unit 3 determines that the contact detection unit 22 as the target block is in the contact detected state, the procedure leaves the loop from Step S42 to Step S54. Then, the sound control unit 3 determines whether the variable "N_CAP" indicating the number of the contact detection units 22 in the contact detected state exceeds a predetermined threshold "N_CAP_THR" or not (Step S55). That is, when the number of the contact detection units 22 determined as in the contact detected state exceeds a predetermined threshold at the contact detection unit 22 as the target block, the sound control unit 3 determines that the contact detection unit 22 as the target is in the contact detected state. Then the determination at Step S55 results in YES, the sound control unit 3 stores "1" at the variable "CAP_DET" (Step S56), and returns the value "1" of the variable "CAP_DET" to the main routine (Step S57). On the contrary, when the determination at Step S55 results in NO, Step S56 is skipped. Then the sound control unit 3 returns the value "0" of the variable "CAP_DET" to the main routine (Step S57).

(Velocity Detection Processing)

As shown in FIG. 8, in the velocity detection processing, the sound control unit 3 firstly initializes variables to be used(=0) (Step S61). The variables to be initialized here include a variable "VAD_VELO" to store a detected value (AD value) of the slapping detection units 21 and a variable "VAD_VELO_MAX" to store a maximum value of the detected values at the slapping detection units 21.

Next, the sound control unit 3 starts the timer processing as an external function (Step S62) and executes loop processing from Step S63 to Step S69. This loop processing is to acquire a maximum detected value of the slapping detection unit 21 as the target block during the slapping determination time specified by a constant "TIME_VDEC". Firstly, the sound control unit 3 acquires a detected value of the slapping detection unit 21 at the block specified by a variable "BLOCK" (Step S64) and stores this in the variable "VAD_VELO" (Step S65). Then the sound control unit 3 determines whether the value of the variable "VAD_VELO" is larger than a variable "VAD_VELO_MAX" or not (Step S66). When this determination results in YES, the sound control unit 3 stores the value of the variable "VAD_VELO" into the variable "VAD_VELO_MAX" (Step S67), and updates the variable "TIME" (Step S68). Then the procedure returns to Step S63. On the contrary, when the determination at Step S66 results in NO, Step S67 is skipped, and the sound control unit 3 updates the variable "TIME" (Step S68). Then the procedure returns to Step S63.

When the slapping determination time specified by the constant "TIME_VDEC" has passed, the procedure leaves the loop from Step S63 to Step S69. Then the sound control unit 3 initializes the variable "TIME" (Step S70) and ends the timer processing (Step S71). Then the sound control unit 3 returns the value of the variable "VAD_VELO_MAX" to the main routine (Step S72).

(Timer Processing)

As shown in FIG. 9, the timer processing includes a timer-start waiting loop processing from Step S81 to Step S83, and a timer activated loop processing from Step S84 to Step S87. In the timer-start waiting loop processing from Step S81 to Step S83, the variable "Time_CNT" to store the count value is repeatedly initialized(=0) (Step S82). When the flag "flag" shows "1", the procedure leaves the loop and shifts to the timer activated loop processing from Step S84 to Step S87.

In the timer activated loop processing from Step S84 to Step S87, the increment processing of the variable "Time_CNT" (Step S85) and the return processing to return the value of the variable "Time_CNT" to a higher-rank routine (Step S86) are repeated. When "0" is designated in the flag "flag" (Step S86), the procedure leaves the loop and the timer processing ends.

As stated above, the electronic percussion instrument 1 according to one embodiment of the present invention includes: the striking surface 12; the slapping detection units 21 configured to detect the strength and the place of slapping on the striking surface 12; the contact detection units 22 configured to detect a contact by a player on the striking surface 12; and a sound control unit 3 configured to change at least one of the loudness and the pitch of sound generated by the sound output unit 4 based on the strength or the place of slapping on the striking surface 12 detected by the slapping detection units 21 and to change the sound generated by the sound output unit 4 based on a contact to the striking surface 12 detected by the contact detection units 22.

With this configuration, the electronic percussion instrument 1 simply can change the tone of sound based on the strength and the place of slapping, and can realize play by a slapping operation together with a contact operation. For instance, the tone of sound can be changed by performing a slapping operation with one hand while touching the striking surface 12 with the other hand, or the sound can be cancelled by touching the striking surface 12 after a slapping operation.

That is the descriptions on the present invention by way of the specific embodiment, and the technical scope of the present invention is not limited to the above embodiment. It will be appreciated for a person skilled in the art that the above-stated specific embodiments can be modified or improved in various ways. It should be understood that we intend to cover by the appended claims such modified or improved embodiments falling within the technical scope of the present invention.

In the present embodiment, the striking surface 12 is only one face at the front face of the cubic shape. Instead, the striking surface may be a left or right lateral face, or may be two faces including both lateral faces or three faces.

In the present embodiment, the electric circuit of the contact detection units 22 is disposed on the rear face of the circuit board 72. Instead, the contact detection units 22 may be disposed at a blank space between the slapping detection units 21 on the surface of the circuit board 72, or may be formed in the circuit board 72, i.e., as one layer of the laminated board. Aside from the circuit board 72 to make up the slapping detection units 21, an electric circuit exclusively used for the contact detection units 22 may be disposed.

The electronic percussion instrument 1 in the present embodiment is implemented as an electronic cajon, which may be other percussion instruments, such as a bongo. The speaker 41 of the sound output unit 4 may be disposed separately from the electronic percussion instrument 1.

In the embodiment as stated above, the control unit to perform various types of control is implemented through execution of a program stored in the ROM (memory) by the CPU (general-purpose processor). Instead, each of the plurality of types of control may be performed by the processor for exclusive use. In this case, such a processor for exclusive use may include a general-purpose processor (electronic circuit) that can execute any program and a memory to store a control program dedicated to the control, or may include an electronic circuit for exclusive use dedicated to the control.

For example, when a CPU (general-purpose processor) executes a program stored in a ROM (memory), examples of the processing and the program executed by the CPU are as follows.

CONFIGURATION EXAMPLE 1

The CPU is configured to control sound generated in accordance with the place of a contact operation to the striking surface and in response to detection of a slapping operation to the striking surface.

CONFIGURATION EXAMPLE 2

In the above configuration example, the CPU is configured to control sound generated in response to detection of a slapping operation on a first position of the striking surface in accordance with the place of a contact operation to the striking surface.

CONFIGURATION EXAMPLE 3

In the above configuration example, the CPU is configured to control sound generated in accordance with combination of the place of a slapping operation on the striking surface and the place of a contact operation to the striking surface.

CONFIGURATION EXAMPLE 4

In the above configuration example, the CPU is configured to control generated sound whether the place of a slapping operation on the striking surface and the place of a contact operation to the striking surface are within the same range or not.

CONFIGURATION EXAMPLE 5

In the above configuration example, the CPU is configured to, when the place of the slapping operation and the place of the contact operation are not within the same range, change sound generated in response to detection of the slapping operation, and when the place of the slapping operation and the place of the contact operation are within the same range, control so as not to change sound generated in response to the slapping operation.

CONFIGURATION EXAMPLE 6

An electronic percussion instrument includes: a first sensor to detect a slapping operation on the striking surface;

a second sensor to detect a contact operation to the striking surface; and a processor to control sound generated in response to detection of a slapping operation by the first sensor in accordance with the place of a contact operation to the striking surface detected by the second sensor.

CONFIGURATION EXAMPLE 7

In the above configuration example, the first sensor detects the strength of a slapping operation on the striking surface and the place of the slapping operation on the striking surface, the second sensor detects the place of a contact operation to the striking surface, and the processor is configured to change at least one of the loudness and the pitch of sound generated by the sound output unit based on a difference in the strength or the place of the slapping operation detected by the first sensor and change the sound generated by the sound output unit based on the contact operation detected by the second sensor.

CONFIGURATION EXAMPLE 8

In the above configuration example, the processor is configured to cancel the sound generated in response to detection of a slapping operation on the striking surface by the first sensor in response to detection of a contact operation detected by the second sensor.

CONFIGURATION EXAMPLE 9

In the above configuration example, the processor is configured to, when a contact operation is detected by the second sensor during generation of sound, cancel the sound being generated.

CONFIGURATION EXAMPLE 10

In the above configuration example, the processor is configured to, when an output value of a threshold or more is detected by the second sensor for a set time, determine that the contact operation is performed.

CONFIGURATION EXAMPLE 11

In the above configuration example, the striking surface includes a plate member that can be elastically deformed, the first sensor detects the strength of a slapping operation on the striking surface and the place of the slapping operation on the striking surface based on a change in resistance that changes with a contacting state between conductive thin films opposed on a face of the plate member, and the second sensor detects the place of the contact operation to the striking surface based on a change in capacitance detected by a detection unit disposed at a face of the plate member so as to correspond to the first sensor.

CONFIGURATION EXAMPLE 12

In the above configuration example, the striking surface includes one plate member, the first sensor includes a plurality of sensors disposed at a plurality of corresponding places at a face of the plate member, and the second sensor includes a plurality of sensors disposed at a plurality of corresponding places at a face of the plate member.

CONFIGURATION EXAMPLE 13

In the above configuration example, the first sensor is disposed at a position closer to the plate member than the second sensor is.

When a plurality of processors for exclusive use is used, the number of the processors and how to assign the plurality of types of control to these processors for exclusive use may be determined freely.

What is claimed is:

1. An electronic percussion instrument having a surface, comprising:

a first sensor configured to detect a striking operation on the surface;

a second sensor configured to detect a contact operation to the surface; and a processor configured to control sound generated in response to detection of the striking operation by the first sensor, in accordance with a place of the contact operation to the surface detected by the second sensor;

wherein the processor is configured to control the generated sound based on whether or not a place of the striking operation on the surface detected by the first sensor and the place of the contact operation to the surface detected by the second sensor are within a same range.

2. The electronic percussion instrument according to claim 1, wherein the processor is configured to control sound generated in response to detection of a striking operation on a first position of the surface by the first sensor in accordance with the place of the contact operation detected by the second sensor.

3. The electronic percussion instrument according to claim 1, wherein the processor is configured to control the generated sound in accordance with a combination of the place of the striking operation on the surface detected by the first sensor and the place of the contact operation to the surface detected by the second sensor.

4. The electronic percussion instrument according to claim 1, wherein the processor is configured to, when the place of the striking operation and the place of the contact operation are not within the same range, perform control so as to change the generated sound in response to detection of the striking operation, and when the place of the striking operation and the place of the contact operation are within the same range, perform control so as not to change the generated sound in response to the striking operation.

5. The electronic percussion instrument according to claim 1, further comprising a sound output unit, wherein:

the first sensor detects a strength of the striking operation on the surface and the place of the striking operation on the surface, the second sensor detects the place of the contact operation to the surface, and the processor is configured to change at least one of a loudness and a pitch of sound generated by the sound output unit based on a difference in the strength or the place of the striking operation detected by the first sensor and to change the sound generated by the sound output unit based on the contact operation detected by the second sensor.

6. An electronic percussion instrument having a surface, comprising:

a first sensor configured to detect a striking operation on the surface;

a second sensor configured to detect a contact operation to the surface; and a processor configured to control sound generated in response to detection of the striking operation by the first sensor, in accordance with a place of the contact operation to the surface detected by the second sensor;

wherein the processor is configured to cancel the sound generated in response to detection of the striking operation on the surface by the first sensor in response to the contact operation detected by the second sensor.

7. The electronic percussion instrument according to claim 6, wherein the processor is configured to, when the contact operation is detected by the second sensor during generation of sound, cancel the sound being generated.

8. The electronic percussion instrument according to claim 6, wherein the processor is configured to, when an output value of a threshold or more is detected by the second sensor for a set time, determine that the contact operation is performed.

9. An electronic percussion instrument having a surface, comprising:

a first sensor configured to detect a striking operation on the surface;

a second sensor configured to detect a contact operation to the surface; and a processor configured to control sound generated in response to detection of the striking operation by the first sensor, in accordance with a place of the contact operation to the surface detected by the second sensor;

wherein:

the surface includes a plate member that can be elastically deformed, the first sensor detects a strength of the striking operation on the surface and a place of the striking operation on the surface based on a change in resistance that changes with a contacting state between conductive thin films opposed on a face of the plate member, and the second sensor detects the place of the contact operation to the surface based on a change in capacitance detected by a detection unit disposed at the face of the plate member so as to correspond to the first sensor.

10. The electronic percussion instrument according to claim 9, wherein:

the surface includes the plate member as a single member, the first sensor includes a plurality of sensors disposed at a plurality of corresponding places at the face of the plate member, and the second sensor includes a plurality of sensors disposed at a plurality of corresponding places at the face of the plate member.

11. The electronic percussion instrument according to claim 9, wherein the first sensor is disposed at a position closer to the plate member than the second sensor.

12. A method for controlling generated sound executed by a processor, comprising:

detecting a place of a contact operation to a surface; and controlling sound generated in response to detection of a striking operation on the surface in accordance with the detected place of the contact operation;

wherein the processor is configured to control the generated sound based on whether or not a place of the striking operation on the surface and the place of the contact operation to the surface are within a same range.

13. The method for controlling generated sound according to claim 12, wherein the processor is configured to control sound generated in response to detection of a striking operation on a first position of the surface in accordance with the detected place of the contact operation to the surface.

14. The method for controlling generated sound according to claim 12, wherein the processor is configured to control the generated sound in accordance with a combination of the place of the striking operation on the surface and the detected place of the contact operation to the surface.

15. The method for controlling generated sound according to claim 12, wherein the processor is configured to, when the place of the striking operation and the place of the contact operation are not within the same range, perform control so as to change the generated sound in response to detection of the striking operation, and when the place of the striking operation and the place of the contact operation are within the same range, perform control so as not to change the generated sound in response to the striking operation.

* * * * *